US007914101B2

(12) United States Patent
Ohashi et al.

(10) Patent No.: US 7,914,101 B2
(45) Date of Patent: Mar. 29, 2011

(54) INK JET PRINTING APPARATUS WITH INK STIRRING BY CARRIAGE RECIPROCATION

(75) Inventors: Tetsuya Ohashi, Matsudo (JP); Yasuo Kotaki, Yokohama (JP); Ryoji Inoue, Kawasaki (JP); Yoshito Mizoguchi, Kawasaki (JP); Daisaku Ide, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 999 days.

(21) Appl. No.: 11/743,703

(22) Filed: May 3, 2007

(65) Prior Publication Data

US 2007/0263025 A1 Nov. 15, 2007

(30) Foreign Application Priority Data

May 9, 2006 (JP) ..... 2006-130794

(51) Int. Cl.
*B41J 29/393* (2006.01)

(52) U.S. Cl. ..... 347/19; 347/37; 347/85

(58) Field of Classification Search ..... 347/14, 347/19, 23, 32, 37, 38, 39, 84–87
See application file for complete search history.

(56) References Cited

U.S. PATENT DOCUMENTS 6,062,682 A 5/2000 Ahn
6,488,348 B1 * 12/2002 Miura et al. ..... 347/19

FOREIGN PATENT DOCUMENTS

JP 9-309212 A 12/1997
JP 2004-216761 A 8/2004
JP 2005-66520 A 3/2005

* cited by examiner

*Primary Examiner* — Juanita D Stephens
(74) *Attorney, Agent, or Firm* — Fitzpatrick, Cella, Harper & Scinto

(57) ABSTRACT

The present invention provides an ink jet printing apparatus that can print appropriate images by efficiently stirring ink in an ink tank in accordance with its status to homogenize it. When the elapsed time from the end of reciprocation of the carriage is shorter than a specified time, a printing operation is performed after the end of the reciprocation. The number of times that the carriage is reciprocated so as to stir the ink after the printing operation is set in accordance with the number of scans of the carriage during the printing operation.

8 Claims, 8 Drawing Sheets

INK JET PRINTING APPARATUS WITH INK STIRRING BY CARRIAGE RECIPROCATION

BACKGROUND OF THE INVENTION

1. Field of the Invention

The present invention relates to a so-called serial scan type ink jet printing apparatus.

2. Description of the Related Art

Known ink jet printing apparatuses print images by using an ink tank that accommodates pigment ink and a print head that ejects the pigment ink fed from the ink tank. The pigment ink tends to have its pigment component precipitated to the bottom of the ink tank. The precipitated pigment component may produce an area with a higher ink concentration and an area with a lower ink concentration in the ink tank.

Japanese Patent Laid-Open No. 2005-066520 describes an ink jet printing apparatus that performs printing operations by moving a carriage equipped with a print head and an ink tank. The printing apparatus utilizes the inertia force of the carriage during a printing operation to allow a stirrer in the ink tank to stir the ink. According to Japanese Patent Laid-Open No. 2005-066520, the stirrer is integrated with a case of the ink tank by molding. The stirrer extends in the case of the ink tank so as to hang down from its ceiling to bottom. The stirrer has a cylindrical weight formed at its lower end. The stirrer stirs the ink in the ink tank by swinging around its root on the ceiling of the case in the same direction in which the carriage moves, under an inertia force resulting from operations of the carriage including acceleration, stoppage, and reversal.

Japanese Patent Laid-Open No. 2005-066520 describes a stirrer that is freely movable on an inner bottom surface of an ink tank instead of being fixed to its case. The stirrer stirs the ink in the ink tank by moving on the bottom surface of the ink tank under an inertia force resulting from operations of the carriage including acceleration, stoppage, and reversal.

Japanese Patent Laid-Open No. 2004-216761 discloses a stirring mechanism comprising a shaft-like weight that swings around a swinging central shaft in a lateral direction under an inertia force resulting from movement of the carriage and a plurality of fins that swing in the lateral direction integrally with the shaft-like weight. The plurality of fins are juxtaposed in the height direction of an ink tank to evenly stir the ink in the ink tank from its upper layer to lower layer.

A known method for stirring a pigment component precipitated to the bottom of an ink tank provides a moving object or a space in the ink tank to stir the ink utilizing operations of the carriage in the ink jet printing apparatus.

Japanese Patent Laid-Open No. 09-309212 and U.S. Pat. No. 6,062,682 describe a configuration that moves a carriage to stir ink, upon receiving a signal for powering on the printing apparatus, a print signal, or a cleaning signal. A predetermined printing operation and an operation of cleaning a print head are performed after a stirring operation. These documents also describe a configuration that detects the time for which a printing operation is stopped. If the printing operation is stopped for at least a predetermined time (hereinafter referred to as a "stirring operation wait time")), a stirring operation is performed to prevent the precipitation of a pigment component.

As described in Japanese Patent Laid-Open No. 09-309212, if a printing operation is stopped for at least the predetermined time (stirring operation wait time) to keep the ink tank stationary for at least a predetermined time, the ink needs to be sufficiently stirred before the subsequent printing operation or cleaning operation. This is required to achieve favorable printing results and to prevent a pigment component from being fixed in an ink channel.

However, the use period of the ink jet printing apparatus varies; the ink jet printing apparatus is often consecutively operated in very short periods. Obviously, a short printing operation may be repeated during the predetermined stirring operation wait time. Thus, with a simple scheme of waiting for at least the stirring operation wait time to pass before a stirring operation is performed, no stirring operation may be performed over a long period. In this case, the precipitation of the pigment component may progress to cause inappropriate printing in spite of the small amount of pigment component precipitated.

To prevent this problem, a very small value may be set for the stirring operation wait time, after which a stirring operation or a cleaning operation is performed. However, this increases the frequency at which a stirring operation or a cleaning operation is performed, possibly significantly reducing printing speed.

Further, the cleaning operation may include an operation (suction recovering operation) of sucking and discharging ink not contributing to image printing from nozzles in order to avoid blockage in nozzles in the print head and to discharge bubbles mixed into the ink channel. In this case, a suction recovering operation may be performed a predetermined time after the execution of the last suction recovering operation. The suction recovering operation is effective for avoiding the adverse effect of precipitation of the pigment component in areas in the nozzles or ink channel which are not subjected to the stirring operation. However, it is very difficult to discharge all of the pigment component precipitated in the ink tank simply by means of the suction recovering operation.

Further, with a high carriage moving speed and a large printing amount for a printing operation, the ink in the ink tank on the carriage can be expected to be stirred during the printing operation. However, owing to the variation of the printing speed and amount, the ink in the ink tank is not always stirred.

SUMMARY OF THE INVENTION

The present invention provides a printing apparatus that can print appropriate images by efficiently stirring ink in an ink tank in accordance with its status to homogenize it.

In the first aspect of the present invention, there is provided an ink jet printing apparatus including a carriage on which a print head and an ink tank can be mounted, the print head being capable of ejecting ink on the basis of print data, the ink tank supplying ink to the print head, the ink jet printing apparatus performing a printing operation of printing an image on a print medium through reciprocations of the carriage, the apparatus comprising: measuring means for measuring an elapsed time from end of movement of the carriage; acquiring means for acquiring information correlated with the degree of ink stirring involved in the printing operation performed after the carriage movement has been finished; setting means for, if the elapsed time is shorter than a specified time, setting conditions for carriage movement for stirring the ink in the ink tank on the basis of the information acquired; and control means for reciprocating the carriage in accordance with the set movement conditions.

In the second aspect of the present invention, there is provided an ink jet printing apparatus including a carriage on which a print head and an ink tank can be mounted, the print head being capable of ejecting ink, the ink tank supplying ink to the print head, the ink jet printing apparatus performing a printing operation of printing an image on a print medium through reciprocations of the carriage, the apparatus comprising: measuring means for measuring an elapsed time from end of movement of the carriage; acquiring means for acquiring information on conditions for carriage movement involved in the printing operation performed after the carriage movement has been finished; setting means for, if the elapsed time is shorter than a specified time, setting the conditions for carriage movement for stirring the ink in the ink tank on the basis of the information acquired; and control means for reciprocating the carriage in accordance with the set movement conditions after the printing operation.

The present invention measures the elapsed time from the end of reciprocation of the carriage, on which the print head and ink tank can be mounted. Then, when the measured elapsed time is shorter than a specified time, the condition under which the carriage is reciprocated so as to stir the ink in the ink tank is set in accordance with the printing amount based on a printing operation. Then, the carriage is reciprocated in accordance with the condition for reciprocations to enable the ink in the ink tank to be efficiently stirred in accordance with its status. This enables the ink such as pigment ink in the ink tank to be homogenized, allowing appropriate images to be printed.

Further features of the present invention will become apparent from the following description of exemplary embodiments (with reference to the attached drawings).

DESCRIPTION OF THE EMBODIMENTS

Detailed embodiments of the present invention will be described below with reference to the drawings.

First Embodiment

First, description will be given of an ink jet printing apparatus provided with an ink tank in accordance with present invention.

Figure 2:
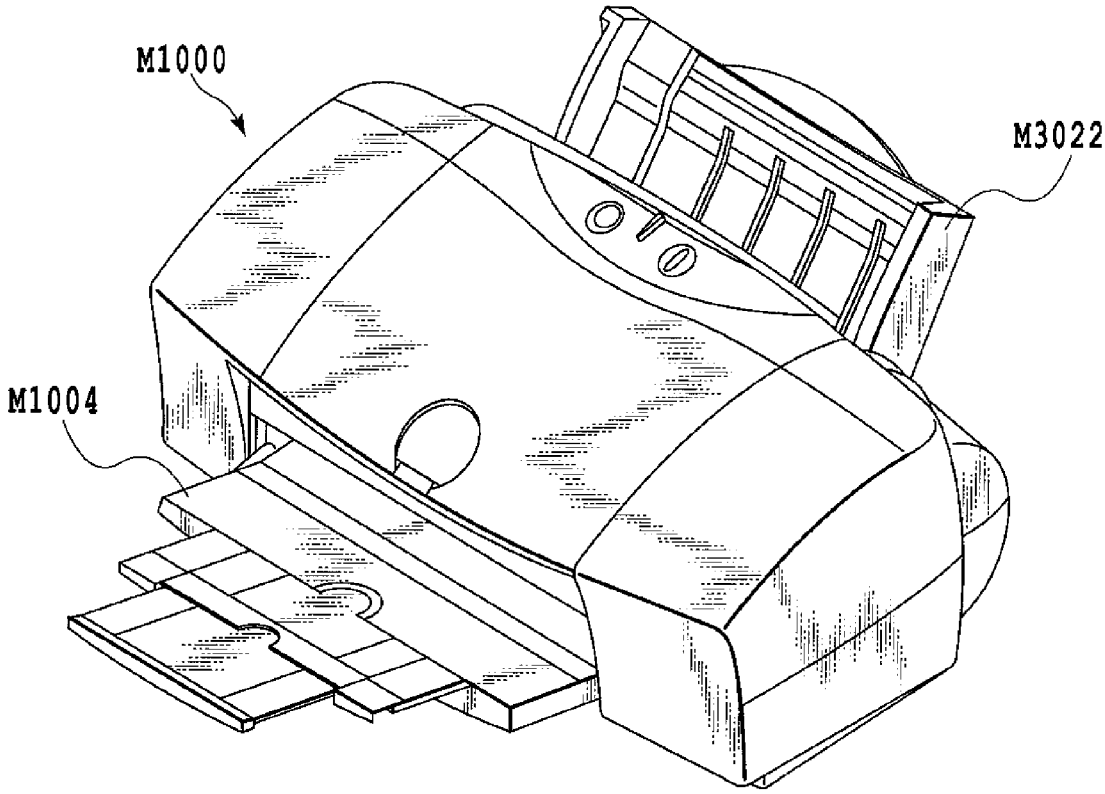
FIG. 2 is a perspective view of the appearance of the ink jet printing apparatus in accordance with the first embodiment of the present invention.
Figure 3:
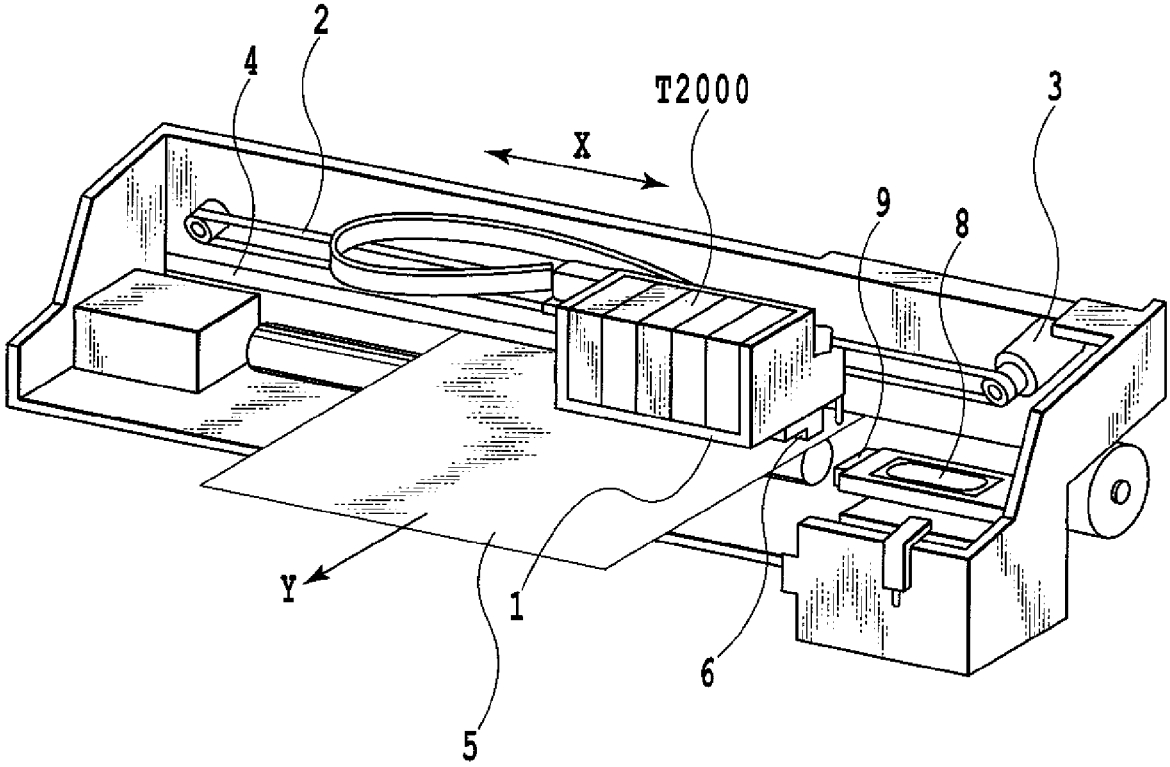
FIG. 3 is a perspective view illustrating a mechanism inside the main body of the ink jet printing apparatus in FIG. 2.

The ink jet printing apparatus is based on a non-impact printing scheme which enables high-speed printing and printing of various print media and which minimizes noise during printing. As shown in FIG. 2, the basic configuration of the ink jet printing apparatus includes an apparatus body M1000, a feeding section M3022 that feeds a print medium such as a sheet, and a sheet discharging tray M1004. A printing operation mechanism is constructed inside the apparatus body M1000 as shown in FIG. 3. An ink jet print head 6 and an ink tank T2000 are releasably mounted on a carriage 1; the ink jet print head 6 performs a desired printing operation on a print sheet (print medium) 5 conveyed to a print position and the ink tank T2000 stores ink to be supplied to the print head 6. The carriage 1 with the print head 6 and ink tank T2000 mounted thereon is reciprocated along a guide shaft 4 in a main scanning direction by the driving force of a carriage motor 3 transmitted via a timing belt 2; the main scanning direction is shown by an arrow X. The print sheet 5 is conveyed in a sub-scanning direction shown by an arrow Y and which crosses (in the present example, which is orthogonal to) the main scanning direction.

The ink tank T2000 is releasable from the print head 6. The print head 6 ejects ink droplets from ejection ports using electrothermal conversion elements (heaters) formed of heating resistors, piezo elements, or the like. With electrothermal conversion element, ink in nozzle is heated by the element to cause bubbling so that the resulting bubbling energy can be used to eject ink droplet from the ejection port.

A capping device 8 is provided at a home position of the print head 6. The capping device 8 has a cap that covers nozzles in the print head 6 having moved to its home position. This prevents the possible evaporation of ink from the nozzles and the fixation of ink in the nozzles. A suction pump (not shown) is connected to the cap through a tube to introduce a negative pressure into the cap covering the nozzles. This enable ink not contributing to image printing to be sucked and discharged from the nozzles (suction recovering operation). Reference numeral 9 denotes a blade that moves relative to the print head 6 to wipe off a surface of the print head 6 in which ejection ports are formed. The ink not contributing to image printing can also be ejected from the nozzles toward the interior of the cap (preliminary ejection). A cleaning operation for cleaning the nozzles and ink channels in the print head 6 may include the suction recovering operation, the wiping operation, and the preliminary ejecting operation.

To print an image, a printing scan performed by the print head 6 and an operation of conveying the print sheet 5 are repeated. In the printing scan, the print head 6 ejects ink from the ejection ports on the basis of image data while moving in the main scanning direction together with the carriage 1. In the conveying operation, the print sheet 5 is conveyed in the sub-scanning direction by a predetermined amount.

Figure 7:
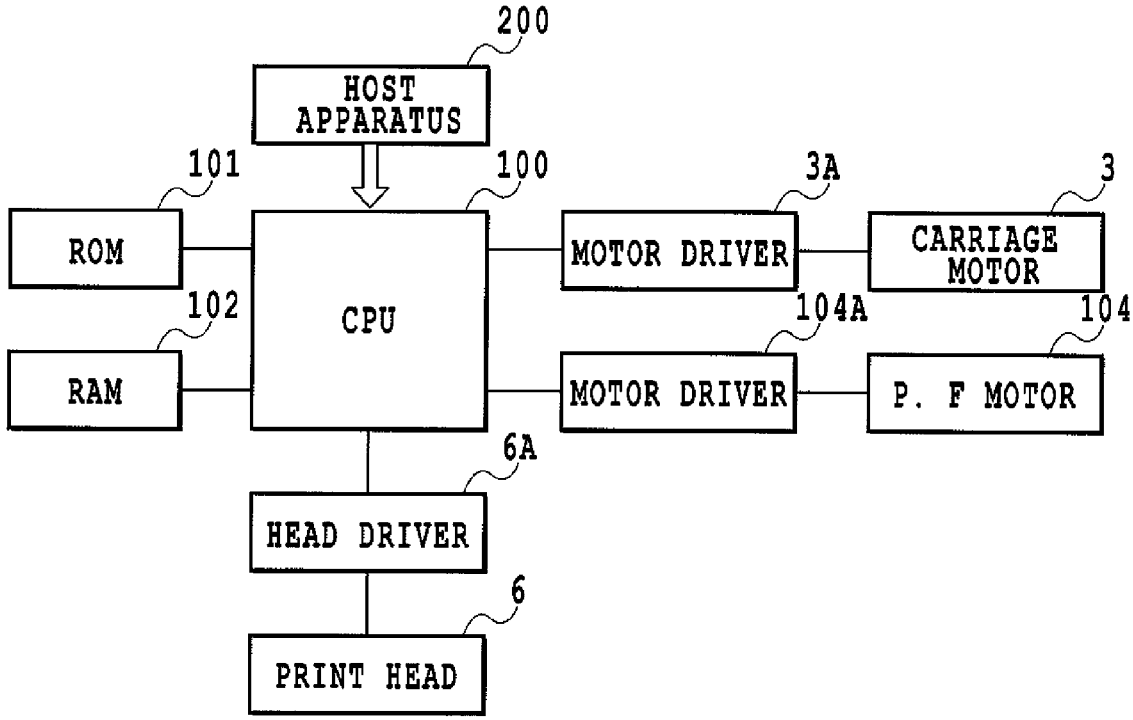
FIG. 7 is a block diagram of a control system in the ink jet printing apparatus in FIG. 2.

FIG. 7 is a block diagram of a control system in the printing apparatus M1000. A CPU 100 executes a process for controlling a stirring operation described below, data processing, and the like. A ROM 101 stores programs for the procedures of the above processes. A RAM 102 is used as a work area in which the processes are executed. Ink ejection from the print head 6 is performed by the CPU 100 by supplying a head driver 6A with driving data (image data) and driving control signals (heat pulse signals) for the electrothermal converters or the like. The CPU 100 controls, via a motor driver 3A, the carriage motor 3, which drives the carriage 1 in the main scanning direction. The CPU 100 also controls, via a motor driver 104A, a P. F motor 104 that conveys the print sheet 5 in the sub-scanning direction.

Figure 4:
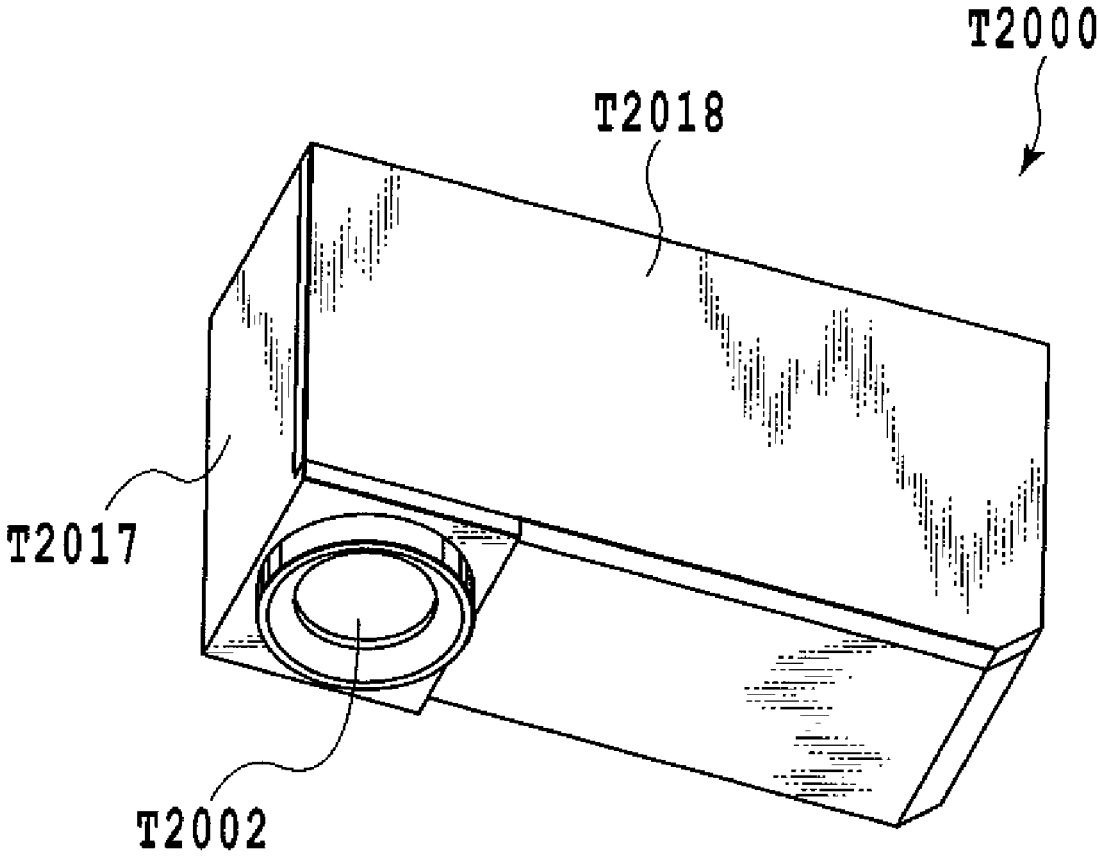
FIG. 4 is a perspective view of an ink tank in FIG. 3.
Figure 5:
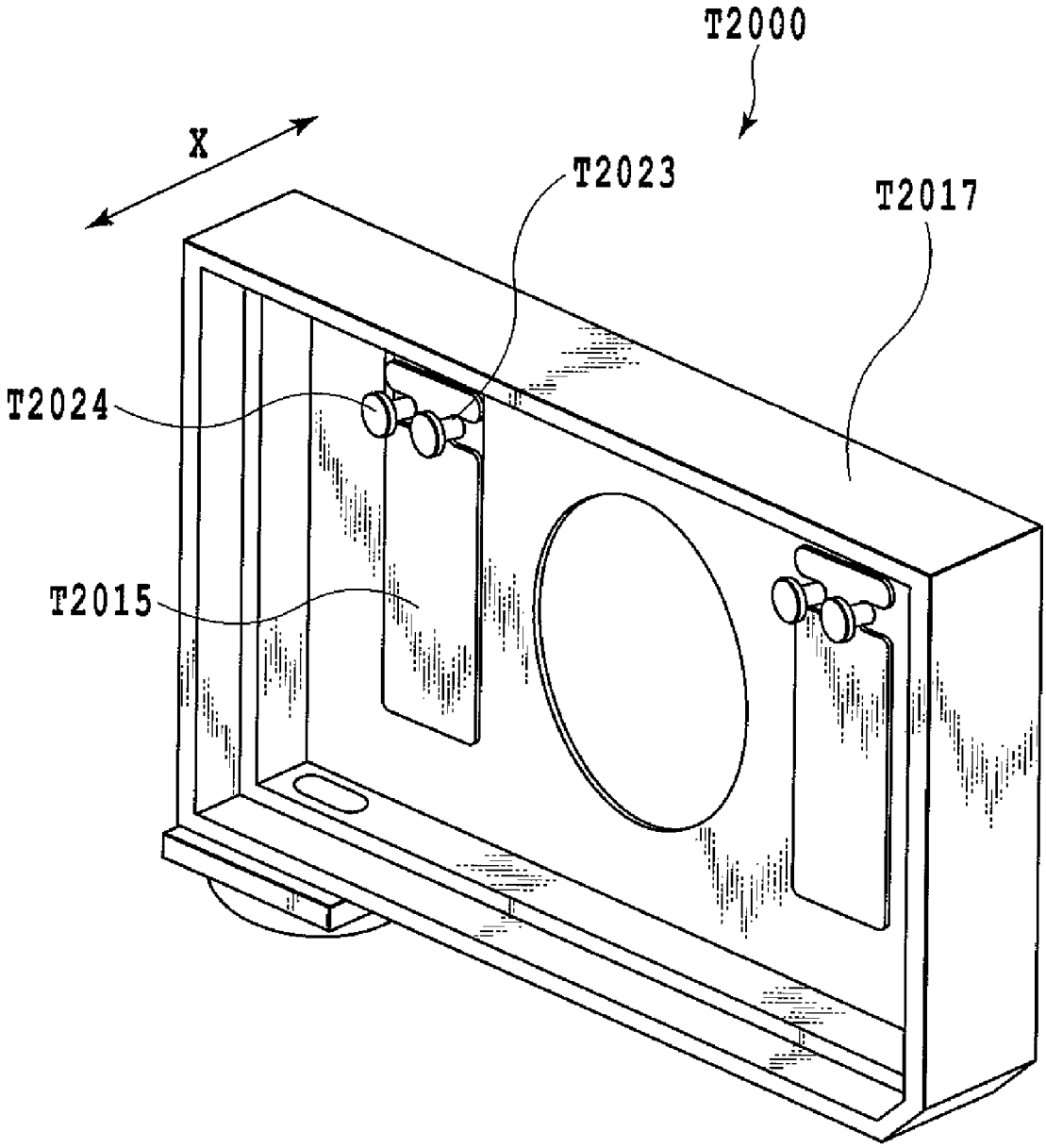
FIG. 5 is a perspective view illustrating the internal configuration of the ink tank in FIG. 4.
Figure 6:
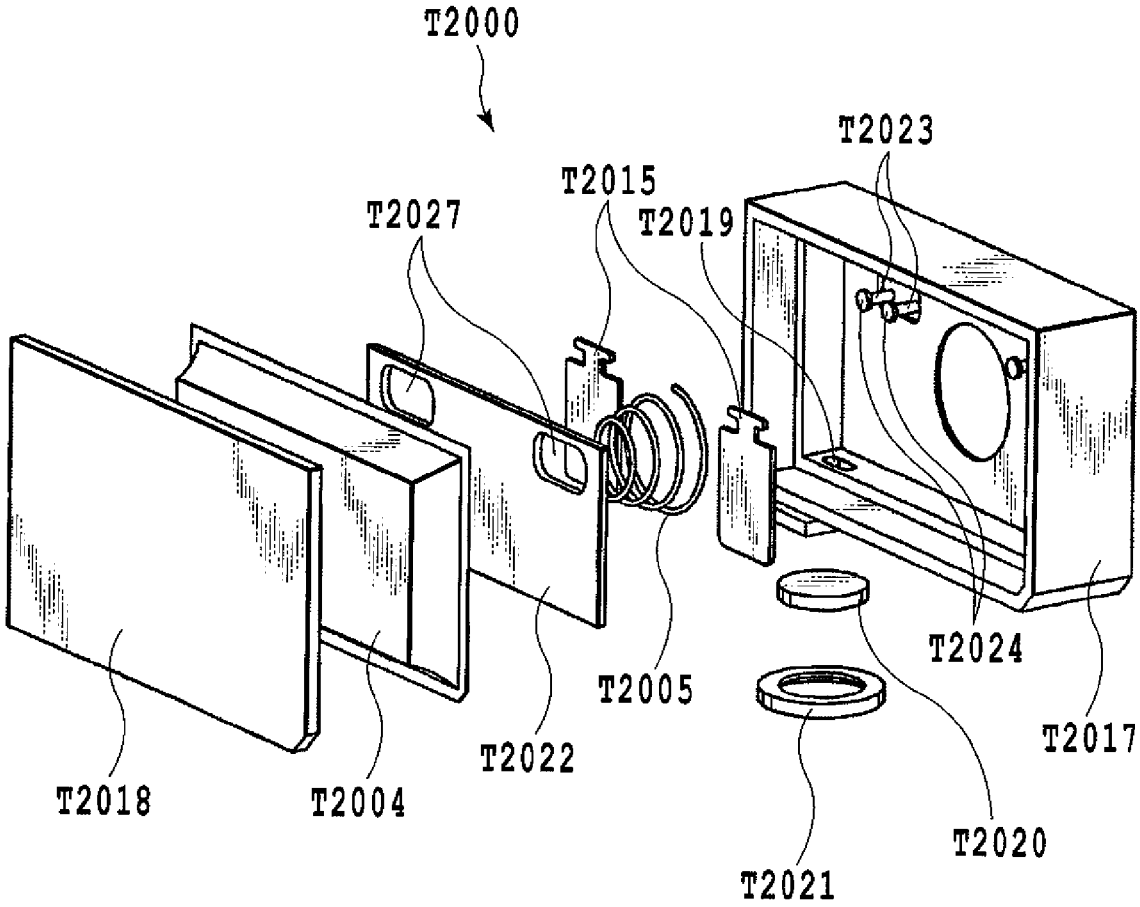
FIG. 6 is an exploded perspective view of the ink tank in FIG. 3.

FIG. 4 is a perspective view of the appearance of the ink tank T2000. FIG. 5 is a perspective view illustrating the internal configuration of the ink tank T2000. FIG. 6 is an exploded perspective view of the ink tank T2000.

The ink tank T2000 is a liquid housing container that houses liquid ink. As shown in FIG. 4, the ink tank T2000 includes a container body T2017 and a cover T2018, with an ink housing chamber formed inside the container body T2017 and cover T2018. The ink tank T2000 has an ink supply port T2002 formed in a bottom surface thereof to supply ink to the print head 6. The ink tank T2000 further includes a spring T2005, a plate T2022, a flexible film T2004, a meniscus former T2020, a retainer plate 2021, and a stirrer (stirring member) T2015 as shown in FIG. 6.

The container body T2017 is formed of, for example, polypropylene. As shown in FIG. 6, the meniscus former T2020 is provided at the ink supply port T2002 at the bottom of the container body T2017. The retainer plate T2021 is fitted around the meniscus former T2020. The meniscus former T2020 comprises, for example, a capillary formed of a fibrous material such as polypropylene or a combination of the capillary and a filter. The filter has a permeation size of about 15 to 30 μm and is made of, for example, a stainless material or polypropylene. The interiors of the meniscus former T2020 and container body T2017 are in communication with each other through an ink channel T2019. This allows ink meniscus to be formed so as to prevent the possible entry of bubbles into an ink housing chamber described below.

A peripheral edge of the flexible film T2004 is soldered to an opening periphery T2016 of the container body T2017. This forms an ink housing chamber that houses ink, between an inner wall of the container body T2017 and the flexible film T2004. The flexible film T2004 comprises, for example, a film including a thin polypropylene film (thickness: about 20 to 100 μm). The flexible film T2004 is urged outward by the spring T2005 via the plate T2022. This generates a negative pressure in the ink housing chamber. Both the spring T2005 and plate T2022 are formed of, for example, a stainless material. The cover T2018 is set in the opening of the container body T2017 to protect the flexible film T2004, which projects outward. The cover T2018 has an air communicating portion (not shown) that sets the inside of the cover T2018, separated from the ink housing chamber by the flexible film T2004, at the atmospheric pressure.

The ink in the ink housing chamber is fed to the print head 6 through the ink supply port T2002. Consumption of the ink contracts the spring T2005 while flexing the flexible film T2004, to reduce the volume of the ink housing chamber. The plate T2022 has an opening T2027 to avoid interference with the support T2023 described below. Thus, the ink in the ink housing chamber can be consumed until the plate T2022 comes into contact with the container body T2017.

The stirrer T2015 is provided with a supported end supported by the support T2023 and a moving end that can be freely swung. The stirrer T2015 can thus be swung in the main scanning direction, which is shown by an arrow X and in which the carriage 1 moves. The stirrer T2015 is composed of a material (for example, SUS) having a specific gravity greater than that of ink. During a printing operation described below and a stirring operation, the stirrer T2015 is swung by an inertia force resulting from the reciprocation of the carriage 1 to stir the ink in the ink housing chamber. The support T2023 has a retainer T2024 at a tip thereof to prevent the stirrer T2015 from slipping out.

Figure 1:
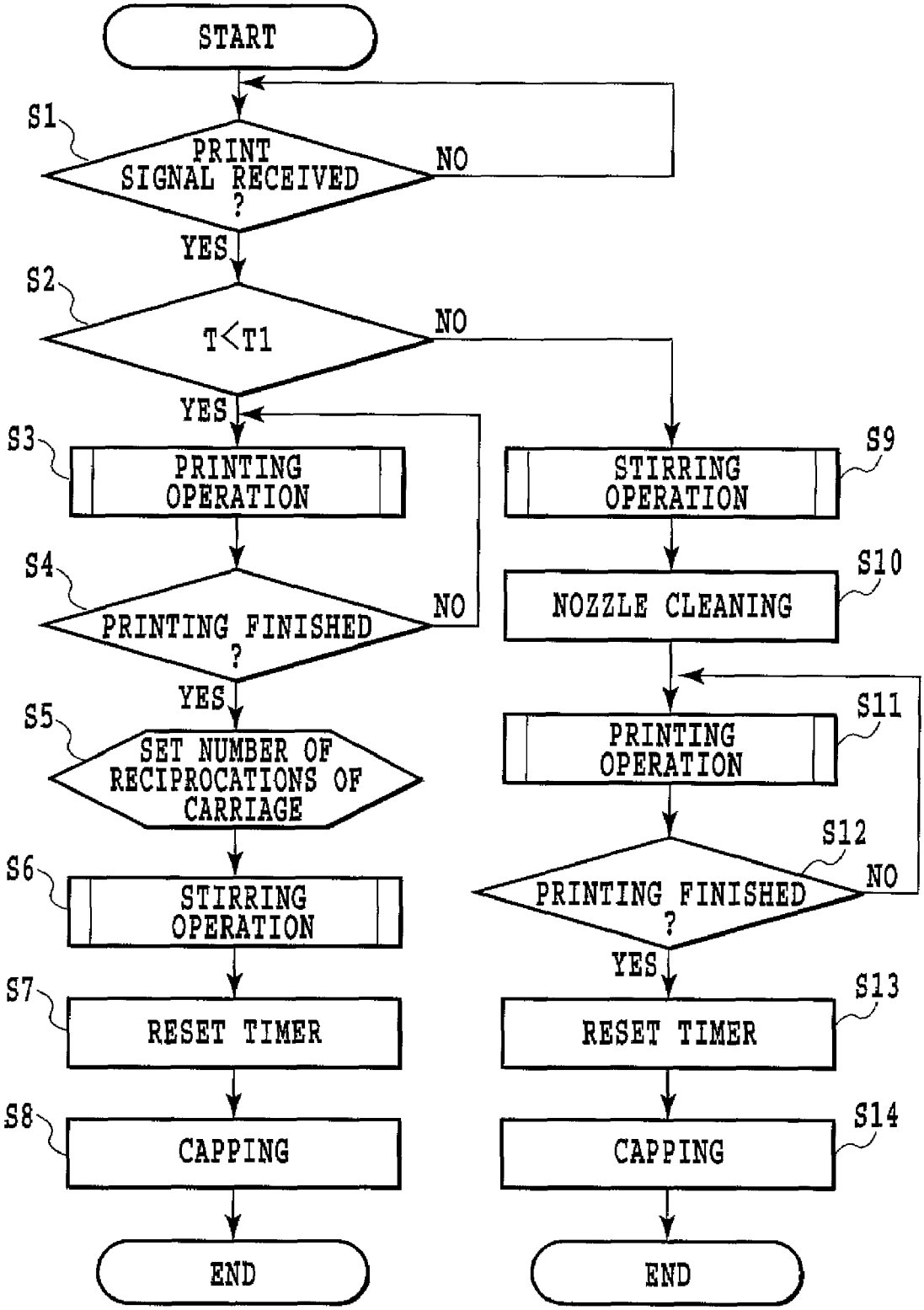
FIG. 1 is a flowchart illustrating operations of an ink jet printing apparatus in accordance with a first embodiment of the present invention.

FIG. 1 is a flowchart illustrating operations performed by the ink jet printing apparatus M1000 in order to stir the ink in the ink tank T2000.

An external apparatus (host apparatus) such as a personal computer (PC) inputs a print signal to the ink jet printing apparatus M1000 (step S1). When the print signal is input, the ink jet printing apparatus M1000 loads the elapsed time T from the end of the last reciprocation of the carriage 1, that is, the elapsed time T from the last stirring of the ink in the ink tank T2000 (step S2). The ink is stirred by the printing operation or the stirring operation, described below. The printing apparatus M1000 or print head comprises a timer that measures the elapsed time T.

If the elapsed time T is shorter than a specified time T1, the printing operation is performed on the basis of the input print signal (step S3). In the printing operation, an image is printed on the print sheet 5 in conjunction with the reciprocation of the carriage on the basis of the input print signal. In this case, the stirrer T2015 swings to stir the ink in the ink housing chamber. The printing operation is repeated on print signals sequentially input by the host apparatus (steps S3 and S4). Once the series of printing operations are finished, the process shifts to step S5 to acquire information correlated with the degree of ink stirring involved in the printing operations. The degree of ink stirring depends on the printing amount of the printing operations. Thus, in this case, the information correlated with the degree of ink stirring involved in the printing operations is information corresponding to the printing amount of the printing operations. Specifically, to obtain the information corresponding to the printing amount of the printing operations, the number of carriage reciprocations, that is, the number of scans, is read. The number of scans may be sequentially counted during the printing operation in step S4 and stored in a storage element provided in the print head. In this case, the printing apparatus can load the contents stored in the storage element.

In step S5, a condition (in this case, the number of carriage movements) for the movement of the carriage made to stir the ink in the ink tank is set in accordance with the number of scans as the printing amount during the printing operation. That is, with a large number of scans, that is, a large printing amount during the printing operation (step S3), the ink stirring during the printing operation is at a relatively high degree. Thus, in this case, the number of reciprocations of the carriage during a stirring operation (step S6) is set at a relatively small value. For example, the number of reciprocations of the carriage during the stirring operation is set at 20. A sufficiently large printing amount eliminates the need for stirring. Thus, in this case, the number of reciprocations of the carriage during the stirring operation is set at 0.

On the other hand, with a small number of scans, that is, a small printing amount during the printing operation (step S3), the ink stirring during the printing operation is at a relatively low degree. Thus, in this case, the number of reciprocations of the carriage during the stirring operation (step S6) is set at a relatively large value. For example, the number of reciprocations of the carriage during the stirring operation is set at 50.

Subsequently, the carriage is reciprocated a set number of times to allow the stirrer T2015 to stir the ink in the ink housing chamber (step S6). At this time, since no image printing operation is performed, the reciprocation of the carriage in step S6 is called a stirring operation.

Thus, the number of reciprocations of the carriage for the stirring operation (step S6) is set in accordance with the degree of ink stirring during the printing operation (step S3). This enables the ink in the ink housing chamber to be stirred using the stirrer T2015. As previously described, if a large number of scans are performed to sufficiently stir the ink during the printing operation (step S3), the stirring operation (step S6) need not be performed.

Now, description will be given of the significance of the stirring operation in steps S5 and S6. If steps S5 and S6 are not provided, then after the printing operation in step S3, the process shifts to a standby state (step S8) without performing any stirring operation. Then, if a printing operation with a very low degree of ink stirring which lasts for a time shorter than a specified time T1, precipitation of pigment in the ink tank gradually progresses. If the use state is repeated without performing any ink stirring operation, then when the ink is used up, dense ink deposited at the bottom of the ink tank is rapidly supplied to the print head to cause inappropriate printing. On the other hand, providing steps S5 and S6 allows a resetting operation to be performed, that is, makes the density of the pigment in the ink tank uniform, every time a printing operation is finished. This enables the ink in the ink tank to be used up without causing inappropriate printing in the above use environment.

After the stirring operation (step S6) is finished, a timer is reset to measure the elapsed time T (step S7). The timer starts measuring the elapsed time T at that point of time. Subsequently, to prevent the evaporation of the ink from the nozzles in the print head 6 and the fixation of the ink in the nozzles, the nozzles are covered by the capping device 8 of the ink jet printing apparatus M1000 (step S8).

On the other hand, if the elapsed time T is longer than the specified time T1 in step S2, then in step S9, the carriage is reciprocated a predetermined number of times to stir the ink in the ink tank (stirring operation) before a printing operation. The nozzles are subsequently cleaned (step S10). During the cleaning operation, a negative pressure is introduced into the cap covering the nozzles of the print head to suck and discharge the ink not contributing to image printing (suction recovering operation) as described above. The suction recovering operation allows a predetermined amount of ink in the ink channel and ink tank to be discharged.

Subsequently, a printing operation (steps S11 and S12) is performed as in the case of steps S3 and S4, previously described. Timer resetting (step S13) and capping (step S14) are then performed as in the case of steps S7 and S8, previously described.

If the elapsed time T from the end of the last carriage movement is short, the precipitation of a pigment component in the ink tank is at a relatively low degree and printing results are thus not virtually affected. Accordingly, if the elapsed time T is shorter than the specified time T1, then as in the case of step S3, a printing operation may be performed without a stirring operation, without posing any problem. In particular, with a large printing operation amount, the ink in the ink tank is sufficiently stirred to enable the inhibition of progress of the precipitation of the pigment component without the need for the stirring operation. On the other hand, with a short elapsed time T and a small printing operation amount, the stirring operation (step S6) is performed after the printing operation (step S3). Thus, the time from the input of a print signal until the end of printing does not include the time required for the stirring operation. Therefore, precipitation of the pigment component of the ink in the ink tank can be alleviated without sacrificing the printing speed.

Further, in place of the number of scans (the number of movements) of the carriage, a dot count value may be used as information corresponding to the printing amount. That is, ink jet printing apparatuses print images by ejecting ink droplets from the print head on the basis of input print signals. Accordingly, the number of ink droplets ejected, that is, the number of dots formed by the ink droplets, corresponds to the printing amount. Thus, the number of ink droplets is counted on the basis of print signals (print data) to obtain a dot count value, which can be used as information corresponding to the printing amount. That is, the number of reciprocations of the carriage during the stirring operation in step S6 can be set in accordance with the dot count value.

Further, the present embodiment adopts information corresponding to the printing amount of printing operations as information correlated with the degree of ink stirring involved in the printing operations. However, the present invention is not limited to this. For example, carriage movement duration, which affects the degree of stirring, may be adopted as information correlated with the degree of ink stirring involved in the printing operations.

Second Embodiment

Figure 8:
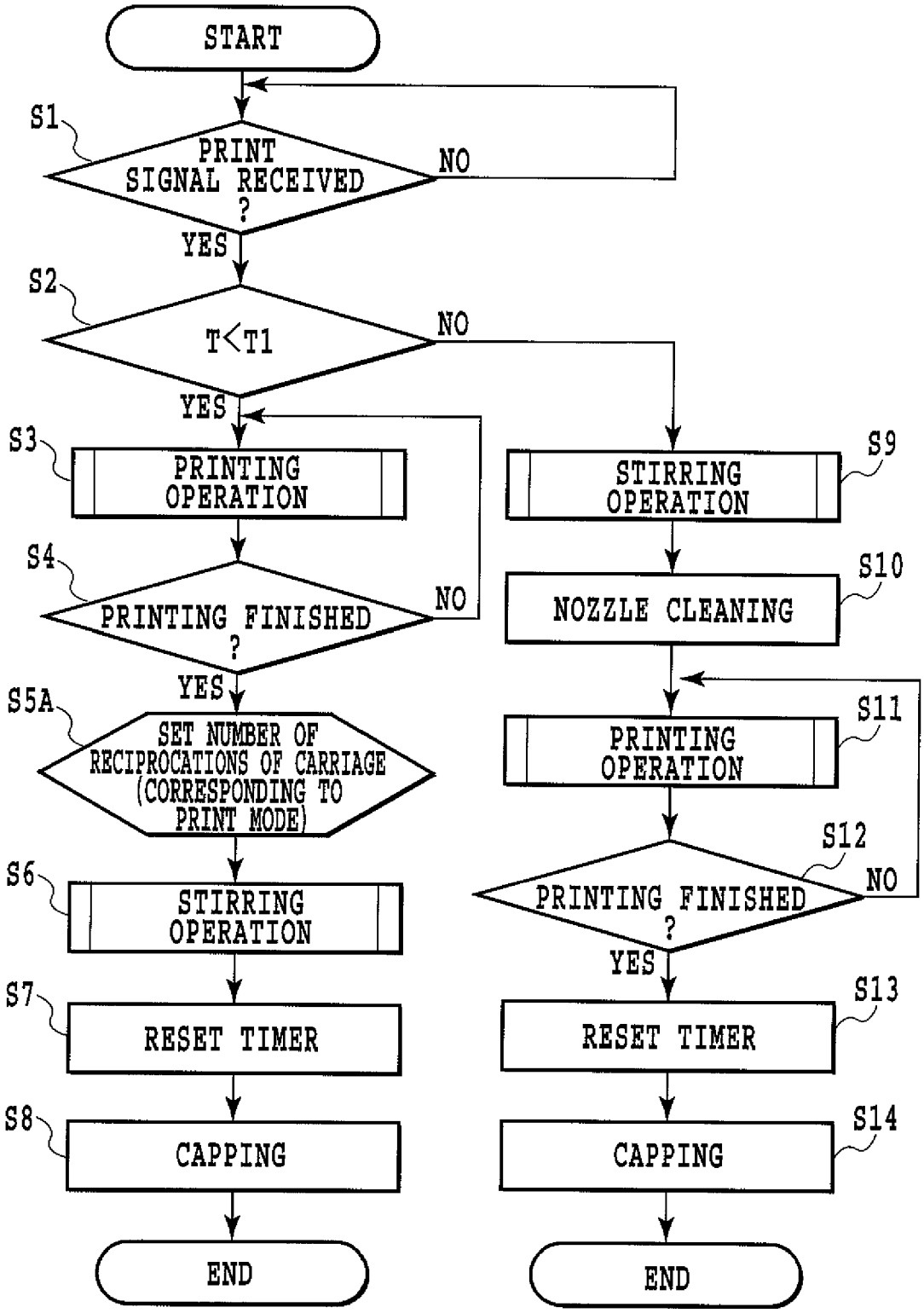
FIG. 8 is a flowchart illustrating operations of an ink jet printing apparatus in accordance with a second embodiment of the present invention.

FIG. 8 is a flowchart illustrating a second embodiment of the present invention. Step S5A of determining the degree of ink stirring involved in printing operations in accordance with the present embodiment is different from step S5 of the first embodiment. In FIG. 8, the same steps as those shown in FIG. 1 are denoted by the same reference numerals and will not be described.

The stirrer T2015, provided in the ink tank, moves through the ink tank to stir the ink under an inertia force resulting from the reciprocation of the carriage. Thus, the movement range and moving speed of the stirrer T2015 increase consistently with the magnitude of the inertia force acting on the stirrer T2015. Ink stirring efficiency increases consistently with the movement range and moving speed of the stirrer T2015. Accordingly, if the carriage moves at a high speed, the degree of ink stirring can be increased even with a small number of carriage movements during a printing operation. Thus, the ink stirring efficiency varies depending on the condition for carriage movements.

Thus, in the present embodiment, at step S5A, the ink jet printing apparatus loads a printing amount corresponding to a print signal and a print mode set on a driver (program) that controls the ink jet printing apparatus. Then, on the basis of this information, the number of reciprocations of the carriage during the stirring operation in step S6 is set. That is, the present embodiment acquires information corresponding to the printing amount and information on the print mode, as information correlated with the degree of ink stirring involved in printing operations.

The print mode is set by selecting one of, for example, a high-speed print mode in which the carriage moves at a high speed, a normal print mode in which the carriage moves at a normal speed, and a high-quality print mode in which the carriage moves at a low speed. The moving speeds of the carriage in the high-speed print mode, normal print mode, and high-quality print mode are defined as Va, Vb, and Vc, respectively, and are in the relationship Va>Vb>Vc. The stirring operation amount required after a printing operation in the high-speed print mode (step S3), that is, the number of reciprocations of the carriage during the stirring operation (step S6), is defined as N(a). Similarly, the stirring operation amount required after a printing operation in the normal print mode (step S3) and the stirring operation amount required after a printing operation in the high-quality print mode (step S3) are defined as N(b) and N(c), respectively. The stirring operation amounts are set to be in the relationship N(c)>N(b)>N(a).

Thus, the stirring operation (step S6) can be more efficiently performed by setting the stirring operation amount in accordance with the moving speed of the carriage during the printing operation (carriage moving condition). That is, a sufficient stirring effect can be exerted even with a small value set for the number of reciprocations required to stir the ink.

The present embodiment acquires information corresponding to the printing amount and information on the print mode, as information correlated with the degree of ink stirring involved in printing operations. However, it is possible that with the acquisition of the information corresponding to the printing amount avoided, only the information on the print mode, that is, the information on carriage movement conditions, is acquired.

Other Embodiments

In the description of the first and second embodiments, the number of carriage movements is set as the condition for carriage movements for the stirring operation. However, in the present invention, the movement condition for the carriage for the stirring operation is not limited to this. The degree of ink stirring varies depending on the moving distance, moving speed, acceleration, and moving time of the carriage. Thus, one of the moving distances, moving speed, acceleration, and moving time of the carriage may be set as the movement condition for the carriage for the stirring operation.

The first and second embodiments adopts the information corresponding to the printing amount of printing operations or the information on the carriage movement conditions (movement count and movement speed), as information correlated with the degree of ink stirring involved in the printing operations. However, the present invention is not limited to this example. For example, if the carriage movement conditions vary depending on the type of the print medium used to print images, the number of carriage reciprocations for ink stirring may be set on the basis of the type of the print medium. That is, information on the type of the print medium is used as information correlated with the degree of ink stirring involved in the printing operation. Moreover, the information on the type of the print medium may be combined with the printing amount, carriage movement conditions, print mode, or the like for the printing operation.

The information correlated with the degree of ink stirring involved in the printing operation includes at least one of the printing amount of the printing operation, the information on the carriage movement condition for the printing operation, the information on the print mode, and the information on the type of the print medium.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2006-130794, filed May 9, 2006, which is hereby incorporated by reference herein in its entirety.

What is claimed is:

1. An ink jet printing apparatus including a carriage on which a print head and an ink tank can be mounted, the print head being capable of ejecting ink on the basis of print data, the ink tank supplying ink to the print head, the ink jet printing apparatus performing a printing operation of printing an image on a print medium through reciprocations of the carriage, the apparatus comprising:

measuring means for measuring an elapsed time from end of movement of the carriage;

acquiring means for acquiring information correlated with a degree of ink stifling involved in the printing operation performed after the carriage movement has been finished;

setting means for, if the elapsed time is shorter than a specified time, setting conditions for carriage movement for stifling the ink in the ink tank on the basis of the information acquired; and control means for reciprocating the carriage in accordance with the set movement conditions, wherein the ink tank comprises a stirring member that is displaced by reciprocations of the carriage to stir the ink.

2. The ink jet printing apparatus according to claim 1, wherein when the elapsed time is shorter than the specified time, the control means reciprocates the carriage in accordance with the movement conditions set after the printing operation has been finished.

3. The ink jet printing apparatus according to claim 1, wherein when the elapsed time is longer than the specified time, the control means reciprocates the carriage in order to stir the ink in the ink tank before the printing operation.

4. The ink jet printing apparatus according to claim 1, wherein the information correlated with the degree of ink stirring involved in the printing operation includes at least one of a printing amount associated with the printing operation, information on carriage movement conditions for the printing operation, information on the print mode, and information on the type of the print medium.

5. The ink jet printing apparatus according to claim 4, wherein the information on the carriage movement conditions for the printing operation relates to at least one of movement speed and movement count of the carriage.

6. The ink jet printing apparatus according to claim 1, wherein the stirring member is supported in the ink tank so as to be able to swing freely.

7. The ink jet printing apparatus according to claim 1, wherein the ink tank accommodates pigment ink.

8. The ink jet printing apparatus according to claim 1, wherein the conditions for carriage movement for stirring the ink includes at least one of movement count, movement speed, movement distance, acceleration, and movement time of the carriage.

* * * * *